United States Patent [19]

Ganz

[11] 4,428,297

[45] Jan. 31, 1984

[54] RAILWAY TRACK TAMPING MACHINE

[75] Inventor: Jorg Ganz, Etoy, Switzerland

[73] Assignee: Sig Societe Industrielle Suisse, Schaffhausen, Switzerland

[21] Appl. No.: 352,755

[22] Filed: Feb. 26, 1982

[30] Foreign Application Priority Data

Mar. 5, 1981 [CH] Switzerland ..... 1465/81

[51] Int. Cl.[3] ..... E01B 27/16

[52] U.S. Cl. ..... 104/12

[58] Field of Search ..... 104/10, 12, 7 R, 2, 104/7 B

[56] References Cited

U.S. PATENT DOCUMENTS

| | | | |
|---|---|---|---|
| 2,789,516 | 4/1957 | Hursh et al. | 104/7 R |
| 3,429,276 | 2/1969 | Plasser et al. | 104/12 |
| 4,130,063 | 12/1978 | Theurer et al. | 104/12 |
| 4,221,169 | 9/1980 | Theurer | 104/10 |

FOREIGN PATENT DOCUMENTS

| | | | |
|---|---|---|---|
| 1759833 | 7/1975 | Fed. Rep. of Germany | 104/7 R |
| 507415 | 6/1971 | Switzerland | 104/12 |

*Primary Examiner*—Robert B. Reeves

*Assistant Examiner*—Donald Hajec

*Attorney, Agent, or Firm*—Anthony J. Casella; Gerald E. Hespos

[57] ABSTRACT

The tamping machine has two tamping units (2,3) which are inclinable transversely to the track in order to tamp the track switches.

Each of these tamping units is articulated at its upper part on a slide (18) which is displaced by a cylinder-piston unit (19) on a transverse slideway (16) fastened on a rigid frame (6). This frame is mounted for pivoting around a vertical axis (X) on two brackets (7, 8) fastened to the frame (1) of the tamping machine.

The inclination of each tamping unit is coordinated with its translation on the slideway (16) by a rod (32) which connects an element (30) of the tamping unit to the chassis (1) so as to reduce the differences in tamping depth caused by the transverse displacement of the tools (25).

The lower portion of the tamping units comprises an arm (34) engaged in a curved slideway (23) fastened to the frame (6) in order to transmit the longitudinal tamping forces to the latter.

2 Claims, 4 Drawing Figures

RAILWAY TRACK TAMPING MACHINE

The object of the present invention is a railway track tamping machine whose rolling chassis is equipped with at least two tamping units to compact the ballast on opposite sides of two lines of rail, each having at least two oscillating and pivoting tools in the form of articulated levers arranged on a tool holder mounted for vertical movement in a gantry inclinable in a plane transverse to the track to permit the tamping of the switch gear, and in which the said gantry is also movable in the longitudinal direction of the track with respect to the chassis in order to permit tamping along each oblique tie of the said switch gear without having to move the said rolling chassis in said direction.

In the known tamping machines of this type, the tamping units are suspended individually by their upper part from a support which is fastened to the rolling chassis around an axis parallel to the longitudinal direction of the track to permit their transverse inclination and is movable by translation along said axis to permit their displacement in the longitudinal direction of the track. The lower portions of these tamping units are either guided, in their combination, in a transverse slideway mounted for pivoting around a vertical axis or else individually connected to the chassis by a transverse cylinder-piston unit.

These tamping machines are satisfactory since they make it possible to assure the correct positioning of the tools at all the switch gear.

However, upon tamping, any lateral force on the tools in the longitudinal direction of the track, caused when they are plunged into the ballast or during the tamping, is felt also in the upper part of the tamping units, thus subjecting their gantries to a bending stress which may be substantial. Furthermore, in the version without slideway connecting the lower portions of the tamping units, the latter must be aligned individually along oblique ties and this causes an additional amount of work for the operators, which is prejudicial to the switch tamping output.

Furthermore, on these tamping machines, the transverse inclination of the tamping units, obtained by pivoting around the axis of the support from which each of them is suspended, has the effect of displacing the tamping tools along a circular path, with the result that upon moving away from the plumb line of said axis the tools rise again with respect to the plane of the track by an amount which is greater the larger the inclination of the gantry.

This phenomenon imposes a limit on the distance between the tamping tools, which can be exceeded only by each time adjusting the downward stroke of the toolholders in the gantries, or else by sacrificing the uniformity of the tamping along the ties. In particular, with this type of articulation, it is not possible to tamp along their entire length long ties which are located below the lines of rail of the two competitive tracks of a simple switch.

On other known types of tamping machines, going beyond the strict scope of the invention, the tamping units are mounted in a frame which pivots around a vertical axis and in which these units are mounted movable by translation in the transverse direction of the track. This mounting makes it possible to assure the uniformity of the tamping, due to the absence of the lifting of the tools while they are moved apart, and permits alignment of all of the tamping units along oblique ties by simple pivoting of the frame, which limits the number of operations required. However, as the length of the frame cannot exceed the railway gauge, the tamping tools cannot be moved apart beyond this gauge, as a result of their mobility by translation within said frame, which has the result that it is not possible to assure the entire tamping of the track switches with tamping machines of this type.

The object of the present invention is to avoid all of the said drawbacks.

For this purpose, the tamping machine of the invention, which is of the type described at the beginning hereof, is characterized by the fact that the tamping units are mounted on a single vertical frame mounted for pivoting around a central vertical axis on two spaced brackets fastened to the chassis, by the fact that this frame has at least one linear fixed slideway perpendicular to its axis of pivoting on which slideway there is mounted, for each tamping unit, a slide moved by a drive member and on which the gantry of the said tamping unit is mounted for pivoting in a plane parallel to the said frame, by the fact that the pivoting of said gantry in the slide and the translation of the latter on the slideway are coordinated by a coordination rod connecting an element of the gantry remote from its articulation to a fixed element in the transverse direction of the track, and by the fact that the lower portion of the said gantry has a retention element engaged in a second slideway which is remote from the slide and fastened to the frame.

In this way, a part of the transverse displacement of the tamping tools is obtained by a translation resulting in a decrease in the amount by which they rise with respect to the plane of the track and the other part of this displacement is obtained by an inclination which makes it possible to bring them beyond the gauge of the frame.

Furthermore, the stresses due to the tamping are transmitted to the frame by the two slides, and the group of tamping units can be aligned along oblique ties by pivoting of the frame.

One embodiment of the object of the invention is shown, by way of example, in the accompanying drawing in which.

Figure 1:
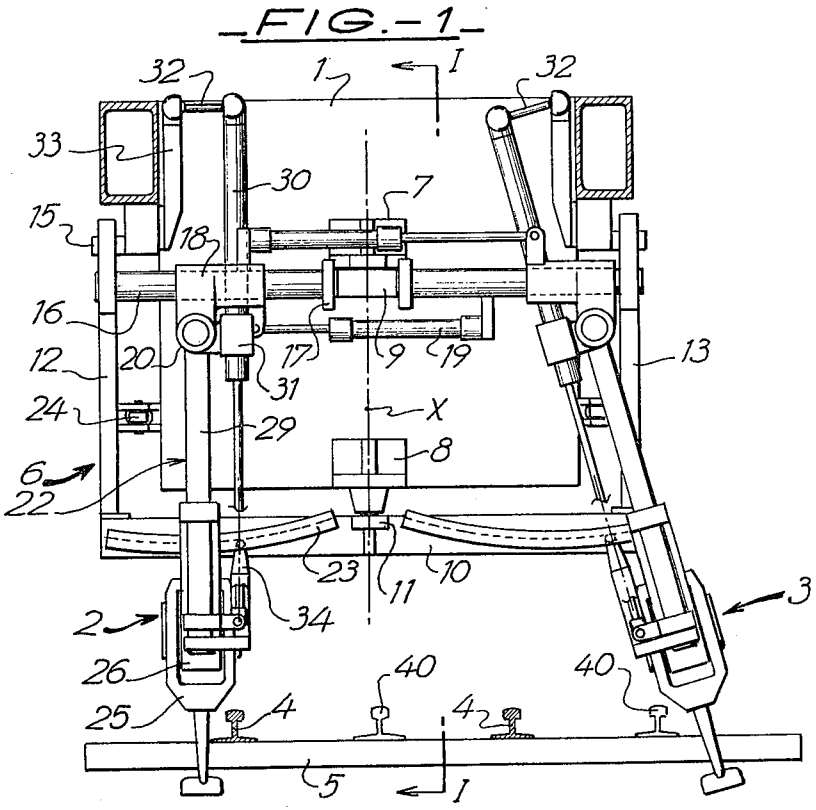
FIG. 1 is a view in elevation, in the transverse plane of the track.
Figure 2:
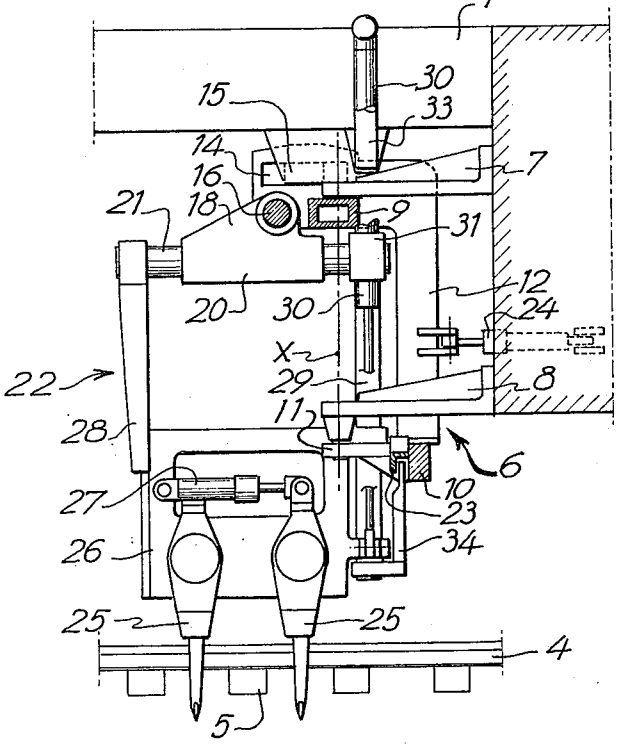
FIG. 2 is a profile view in cross section along the line I-I of FIG. 1.

These figures refer to the tamping units of the tamping machine, of which there is only shown a portion of the rolling chassis 1 supporting these units, two of which are shown here, marked 2 and 3, arranged substantially above a line of rail 4 of the track, a long tie 5 of which is shown in FIG. 1.

The two tamping units 2 and 3 are mounted for inclination in a plane transverse to the track in a single, rigid, vertical frame 6 mounted for pivoting around a central vertical axis X on two spaced brackets 7 and 8 fastened to the rolling chassis 1.

Figure 4:
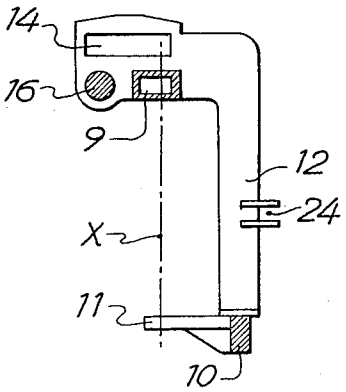
FIG. 4 is a profile view of a detail of FIG. 1.
Figure 3:
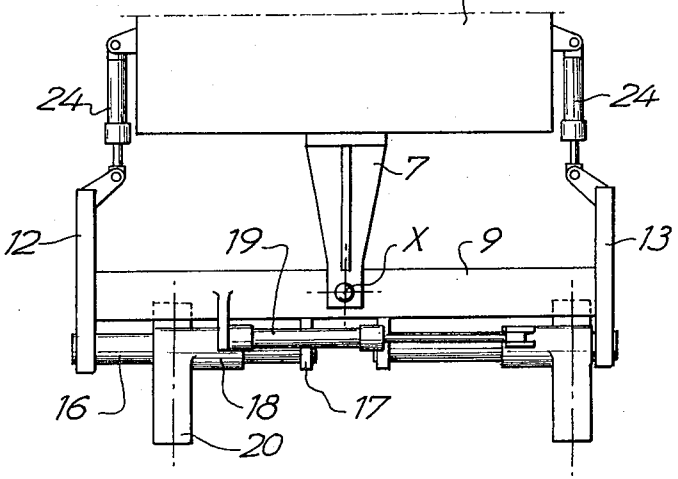
FIG. 3 is a partial top view thereof.

This frame 6 has two parallel horizontal cross members 9 and 10 and two vertical uprights 12 and 13 connecting the ends of said cross members. The upper cross member 9 is articulated at its center to the bracket 7 and the lower cross member 10 bears a central arm 11 articulated on the bracket 8, these two cross members being staggered in the longitudinal direction of the track in order to permit the free passage of the tamping units to the outside of the frame in the plane of the uprights 12 and 13 which, for this purpose also, are in the form of an inverted L, as can be clearly noted in FIG. 4.

The upper part of the two uprights 12 and 13 has a rectangular opening 14 acting as slideway in which there is engaged a support 15 of rectangular cross section rigidly connected to the chassis 1, this support having the function of transmitting to the chassis 1 the vertical forces due to the weight itself of the assembly of the tamping units and frame and those in the same direction developed during the tamping, while permitting the pivoting of the frame 6 insofar as useful.

For each tamping unit the frame 6 also has in its upper portion a linear slideway 16 of circular cross section in order to simplify the construction, fastened on the one side in one of the two uprights 12 and 13 and on the other side in a bracket 17 fastened to the upper cross member 9, this slideway being perpendicular to the axis X of pivoting of the frame. A single slideway for the two units would be just as suitable for the operation but would be subject to additional stresses.

On each of the two slideways 16 there is mounted a slide 18 moved by a hydraulic cylinder-piston unit 19 and on which there is articulated, in a bearing-shaped part 20 perpendicular to said slideway, the upper cross member 21 of the gantry 22 of a tamping unit.

Also, for each tamping unit the frame 6 has a second slideway 23, in this case curved, which is fastened against and along its lower cross member 10.

Finally, the two uprights 12 and 13 of this frame 6 are connected to the chassis 1 by two hydraulic cylinder-piston units 24 intended to control its pivoting around the vertical axis X.

The tamping units 2 and 3 are each of the type having two oscillating and pivoting tools 25 in the form of levers, articulated, arranged in opposition, on a tool holder 26 containing the mechanism for the oscillating of these tools. Their pivoting, which is intended to assure the closing of their picks around each tie, is obtained by two hydraulic cylinder-piston units 27, one per tool, only one of which is visible, resting against the tool holder.

The tool holder 26 is mounted for vertical movement in the gantry 22 between two uprights 28 and 29, the upper ends of which are connected by the aforementioned cross member 21. This tool holder 26 slides along these two uprights and its movements of descent and ascent are obtained by a hydraulic cylinder-piston unit 30 the body of which is rigidly attached in a support 31 which is integral with the cross member 21 and projects beyond the frame 6 in the chassis 1 by a distance dictated by its useful stroke.

In order to coordinate the pivoting of the gantry 22 in the slide 18 with the translation of the latter on the slideway 16, a coordination rod 32 is installed, connected, by two universal end articulations, on the one end to the upper end of the cylinder-piston unit 30 and on the other end to a bracket 33 fastened to the chassis 1.

This coordination of movements serves the desired purpose of reducing, for a given inclination of the tamping unit, the curvature of the curved path of the tamping tools in order to minimize their ascent with respect to the plane of the track, a portion of the stroke of the tools leading to this inclination of the tamping unit being produced by a translation parallel to the plane of the track.

The manner of coordination applied here furthermore permits dispensing with a second drive member and with an additional manipulation.

Furthermore, the use of the cylinder-piston unit 30 as connecting element to the coordination rod 32 is an economical solution since this cylinder-piston unit is in any event indispensable for the control of the descent and ascent of the tool holder 26. It avoids the installing of an additional element in order to fulfill this function.

In order to transmit to the frame 6 the forces suffered by the tamping tools 25 in the longitudinal direction of the track, the lower portion of each gantry 22 has a retaining element, in this case an arm 34 fastened to the bottom of the upright 29, the end of which is engaged in the curved slideway 23.

In the embodiment which has just been described, each tamping unit 2 and 3 is intended to tamp on both sides of each line of rail 4 of the track followed by the tamping machine and permits the tamping of both sides of the two lines of rail 40 of the competitive track of a simple switch and along a long tie 5, as shown in FIG. 1.

However, the invention is also applicable with four tamping units, each intended to tamp only one side of a line of rail. For this purpose, the frame 6 will bear in its upper portion a second line of slideways, arranged parallel to the slideway 16 and at the same level, the strokes of the slides 18 being capable of being reduced to what is necessary on all of the slideways and the number of the curved slideways 23 will be increased to four, the length of each of them being limited to what is useful on both sides of the plumb line of each of the two lines of rail 4. Furthermore, due to their short length, these slideways 23 can be linear with sufficient vertical play to absorb the camber of the curvature of the trajectory of the retaining arm 34 of each gantry.

Finally, two additional advantages provided by the invention may be mentioned:

Due to the simplicity of the manipulations necessary for the putting in place of the tools in the track switches along a long oblique tie which are reduced to a single pivoting of the frame 6 and a single inclination of each tamping unit 2 and 3, without the necessity of acting on the adjustment of the depth of tamping, a single operator can assure the tamping at all configurations of the track.

Due also to the small number of means necessary for these manipulations, which are reduced to the driving of the cylinder-piston units 24 and 19, one can more easily contemplate automating them in order to respond to the present trend, which includes ever greater automation in tamping cycles based on the detection and predicting of obstacles.

What is claimed is:

1. A railway track tamping machine whose rolling chassis (1) is equipped with at least two tamping units (2, 3) for compacting the ballast on opposite sides of two lines of rail, each having at least two oscillating, pivoting tools (25) in the form of articulated levers arranged on a tool holder (26) mounted for vertical movement in a gantry (22) which can be inclined in a plane transverse to the track to permit the tamping of track switches and in which the said gantry is also movable in a longitudinal direction of the track with respect to the chassis in order to permit tamping along each oblique tie of the said switches without having to displace the said rolling chassis in said direction, characterized by the fact that the tamping units (2, 3) are mounted on a single vertical frame (6) mounted for pivoting around a central vertical axis (X) on two spaced brackets (7, 8) fastened to the chassis (1); by the fact that said frame has at least one linear fixed slideway (16) perpendicular to its axis of pivot on which there is mounted, for each tamping unit, a slide (18) moved by a drive member (19) and on which the gantry (22) of said tamping unit is mounted for pivoting in a plane parallel to said frame; by the fact that the pivoting of said gantry in the slide and the translation of the latter on the slideway are coordinated by a coordinating rod (32) connecting an element of the gantry which is remote from its articulation to a fixed element in the transverse direction of the track; and by the fact that the lower portion of the said gantry has a retention element (34) engaged in a second slideway (23) remote from the slide and fastened to the frame.

2. A tamping machine according to claim 1, characterized by the fact that it has a cylinder-piston unit for the control of the vertical displacement of the tool holder (26) of each tamping unit, whose body (30) is rigidly fastened to the gantry (22) and extends above its articulation in the slide (18), and by the fact that the coordination rod (32) is installed connected to two universal end articulations, on its one end with the upper end of the body (30) of the said cylinder-piston unit and on its other end with a bracket (33) fastened on the chassis (1).

* * * * *